US006697583B2

(12) United States Patent
Ishii

(10) Patent No.: US 6,697,583 B2
(45) Date of Patent: Feb. 24, 2004

(54) IMAGE FORMING METHOD AND IMAGE FORMING DEVICE USING SAME

(75) Inventor: Hirokazu Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/219,739

(22) Filed: Aug. 16, 2002

(65) Prior Publication Data

US 2003/0035658 A1 Feb. 20, 2003

(30) Foreign Application Priority Data

Aug. 17, 2001 (JP) ..... 2001-248202

(51) Int. Cl.[7] ..... G03G 15/16
(52) U.S. Cl. ..... 399/66
(58) Field of Search ..... 399/45, 44, 66, 399/297, 303, 313

(56) References Cited

U.S. PATENT DOCUMENTS

| | | | |
|---|---|---|---|
| 5,515,146 | A | 5/1996 | Harasawa et al. |
| 5,631,725 | A | 5/1997 | Harasawa et al. |
| 5,812,919 | A | 9/1998 | Takano et al. |
| 5,822,667 | A | 10/1998 | Hayama et al. |
| 5,930,573 | A | 7/1999 | Miyamoto et al. |
| 6,188,862 | B1 | 2/2001 | Ishii |
| 6,282,386 | B1 | 8/2001 | Ishii |

FOREIGN PATENT DOCUMENTS

| | | |
|---|---|---|
| JP | 8-160780 | 6/1996 |
| JP | 10-240023 | 9/1998 |
| JP | 2001-154513 | 6/2001 |
| JP | 2001-331075 | 11/2001 |

*Primary Examiner*—Hoang Ngo
(74) *Attorney, Agent, or Firm*—Oblon, Spivak, McClelland, Maier & Neustadt, P.C.

(57) ABSTRACT

An image forming device, having a contact-type transfer carrying unit for improving the separation property of the transfer paper from an image supporter, such as a photoreceptor, is provided. The belt resistance from the applying current to the transfer belt and the actually applied voltage is determined to control to switch the front-end current switching timing and the current between the transfer papers. If the belt resistance is lowered, the timing for switching the front-end current is delayed and the current between the transfer papers is reduced. If the belt resistance is increased, the timing is advanced and the current is increased. The bias current is applied in a non-image region on the transfer paper, rather than the region between papers in conventional art.

11 Claims, 10 Drawing Sheets extra high

| current between papers | front end Id switching timing La | | | | |
|---|---|---|---|---|---|
| | 0 | 10 | 15 | 20 | 25 |
| 15 | 0/100 | 0/100 | 0/100 | 0/100 | 0/100 |
| 20 | 0/100 | 0/100 | 0/100 | 0/100 | 0/100 |
| 25 | 0/100 | 0/100 | 0/100 | 0/100 | 0/100 |
| 30 | 0/100 | 0/100 | 0/100 | 0/100 | 0/100 |

FIG. 8A high

| current between papers | front end Id switching timing La | | | | |
|---|---|---|---|---|---|
| | 0 | 10 | 15 | 20 | 25 |
| 15 | 8/100 | 0/100 | 0/100 | 0/100 | 0/100 |
| 20 | 6/100 | 0/100 | 0/100 | 0/100 | 0/100 |
| 25 | 6/100 | 0/100 | 0/100 | 0/100 | 0/100 |
| 30 | 4/100 | 0/100 | 0/100 | 0/100 | 0/100 |

FIG. 8B medium

| current between papers | front end Id switching timing La | | | | |
|---|---|---|---|---|---|
| | 0 | 10 | 15 | 20 | 25 |
| 15 | 8/100 | 0/100 | 0/100 | 0/100 | – |
| 20 | 34/100 | 26/100 | 71/100 | 0/100 | – |
| 25 | 41/100 | 32/100 | 11/100 | 8/100 | 0/100 |
| 30 | | | | | |

FIG. 8C low

| current between papers | front end Id switching timing La | | | | |
|---|---|---|---|---|---|
| | 0 | 10 | 15 | 20 | 25 |
| 15 | 32/100 | 26/100 | 10/100 | 0/100 | 0/100 |
| 20 | 26/100 | 32/100 | 8/100 | 36/100 | 36/100 |
| 25 | 47/100 | 42/100 | 43/100 | 39/100 | 43/100 |
| 30 | | | | | |

FIG. 8D extra low

| current between papers | front end Id switching timing La | | | | |
|---|---|---|---|---|---|
| | 0 | 10 | 15 | 20 | 25 |
| 15 | 52/100 | 46/100 | 19/100 | 0/100 | 0/100 |
| 20 | 56/100 | 54/100 | 41/100 | 4/100 | 3/100 |
| 25 | 51/100 | 24/100 | 16/100 | 6/100 | 26/100 |
| 30 | – | – | – | – | – |

FIG. 8E

| belt resistance | La | transfer current between papers |
|---|---|---|
| extra low | 25 | 15 |
| low | 20 | 15 |
| medium | 15 | 15 |
| high | 10 | 20 |
| extra high | 0 | 20 |

FIG. 10

IMAGE FORMING METHOD AND IMAGE FORMING DEVICE USING SAME

CROSS-REFERENCE TO RELATED APPLICATION

This application claims the priority benefit of Japanese application Ser. No. 2001-248202, filed on Aug. 17, 2001.

BACKGROUND OF THE INVENTION

1. Field of the Invention

This invention relates generally to an image forming device. More particularly, the invention relates to an image forming device capable of improving a separation characteristic of a transfer paper in a transfer carrying device.

2. Description of Related Art

Conventionally, a staining amount on a photoreceptor in an image forming device is determined by a value, called printtac ID. For stabilizing the carrying property and improving the separation property of the transfer paper from the photoreceptor when the staining amount is the printac ID or within a certain range, the carrying property can be stabilized by only specifying the resistance of the transfer carrying belt. For example, in the Japanese Laid Open 10-213974, the separation property (carrying property) is improved by specifying the surface resistance of the transfer belt and the surface resistance of a rubber surface, so as to prevent voids from occurring on the image. In this way, the separation property is improved.

However, as the staining amount on the photoreceptor is the printac ID or below a certain critical level, the front end of the transfer paper might not be separated from the photoreceptor. For example, if the toner stained on the photoreceptor is reduced, the attraction force between the transfer paper and the photoreceptor is larger than a force that attracts the transfer paper to the transfer carrying belt. As a result, the front end of the transfer paper is attracted to the transfer carrying belt, and the transfer paper and cannot be carried by the transfer carrying belt. Therefore, there exists a problem that the transfer paper is firmly attracted onto the photoreceptor and is carried by the photoreceptor. When this phenomenon occurs, the front end of the transfer paper will come in contact with a claw on the photoreceptor, and therefore, the toner attached on the claw will adhere onto the transfer paper.

SUMMARY OF THE INVENTION

Accordingly, it is an object of the present invention to provide an image forming device, capable of solving the above problems. The separation property concerning in the present invention does not occur for all paper types, but only for some paper types. As for the method for setting the transfer paper to a paper-feeding unit (or cassette), there are four methods for setting the transfer paper: two for surfaces (front and back surfaces) of the transfer paper, and two for carrying directions of the transfer paper. Each of the four setting directions to the paper-feeding unit will arise slightly different in the strength of the transfer paper.

Accordingly, it is an object of this invention is to provide an image forming device, having a contact type transfer carrying device. The image forming device can improve the separation property of the transfer paper from an image supporter, such as a photoreceptor. In addition, an optimum separation property can be maintained according to a different separation extent from the photoreceptor due to the resistance of the transfer carrying belt.

In order to achieve the above object(s), the invention provides an image forming device, comprising an image supporter for supporting a toner image; a transfer carrying unit (for example, an endless contact type), for supporting a sheet-shaped transfer paper, and for transferring the toner image on the image supporter to the supported transfer paper; a cleaning unit for cleaning the transfer carrying unit; a unit, for stretching and laying the transfer carrying unit; a transfer bias supplying unit, for supplying a transfer bias to the transfer carrying unit; and a resistance detecting unit, for detecting a resistance of the transfer carrying unit. An applying timing for applying the transfer bias to the transfer carrying unit is at least after the transfer paper enters a nip portion between the image supporter and the transfer carrying unit, and an applying position for applying the transfer bias is within a non-image region of the transfer paper In the above image forming device, the applying timing for applying the transfer bias to the transfer carrying unit is changeable according to the resistance detected by the resistance detecting unit.

In addition, a transfer bias, which is applied between the transfer papers, of the transfer carrying unit is changeable according to the resistance detected by the resistance detecting unit.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

FIGS. 8A~8E show differences of the separation property due to the different belt resistance of the transfer belt;

FIG. 10 shows bias values between papers when both the front end current switching and the current switching between papers are performed.

DESCRIPTION OF THE PREFERRED EMBODIMENT

The detail description according to the embodiment of the invention is made with references to the attached drawings.

In the following description, a transfer belt is used to explain the embodiment, but the invention can be also achieved by using other similar element, such as a transfer roller.

Figure 1:
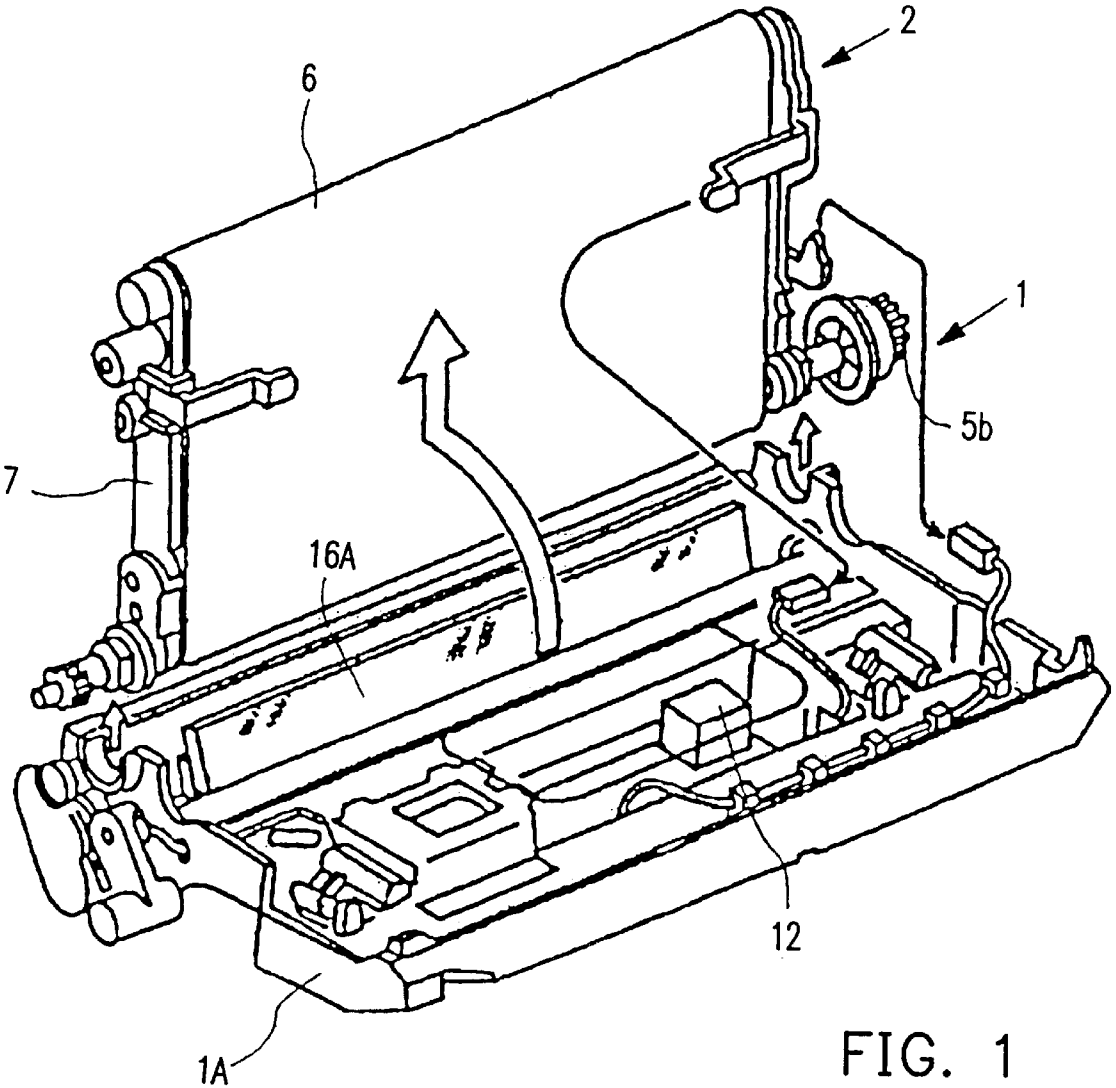
FIG. 1 shows a perspective view of an exemplary transfer carrying device used in an image forming device.
Figure 3:
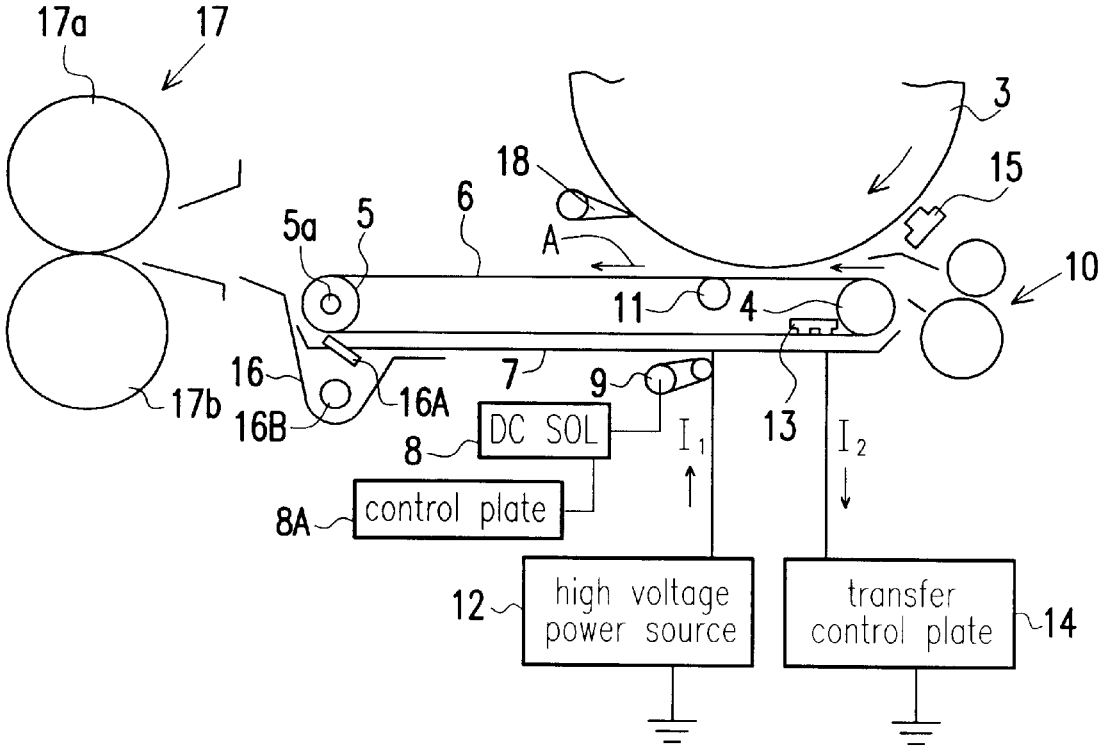
FIG. 3 is conceptual diagram showing a configuration before the transfer operation in the image forming device using the transfer carrying device in FIG. 1.

First, a transfer carrying device for implementing the embodiment of the invention is described in detail. FIG. 1 is a perspective view of an exemplary transfer carrying device used for an image forming device. Referring to FIG. 1, a belt unit 2 is detachably supported by a main body 1A of the transfer carrying device 1. As shown in FIG. 3, the belt unit 2 comprises a transfer belt 6 wound on a pair of rollers 4, 5 for transferring an developing image from a drum-shaped photoreceptor 3, a DC solenoid 8 for engaging or disengaging the transfer belt 6 to the photoreceptor 3, a lever 9, a bias roller 11 for applying a transfer bias to the transfer belt 6, and a contact plate 13 for discharging the charges on the transfer belt 6. In addition, a cleaning device 16 with a cleaning blade 16A for scratching off residual toner adhered on the surface of the transfer belt 6 or paper dross from the transfer paper S, etc, or a high voltage power source 12 for applying a voltage to the bias roller 11 can be further disposed within the main body 1A.

Figure 2:
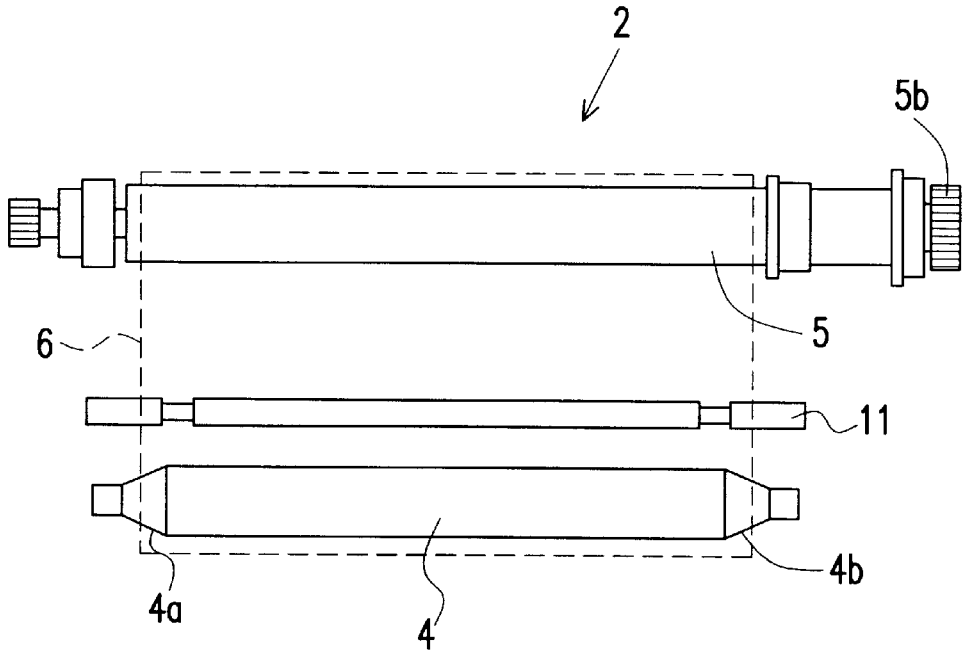
FIG. 2 is a plane view showing a basic structure of the transfer carrying device in FIG. 1.
Figure 5:
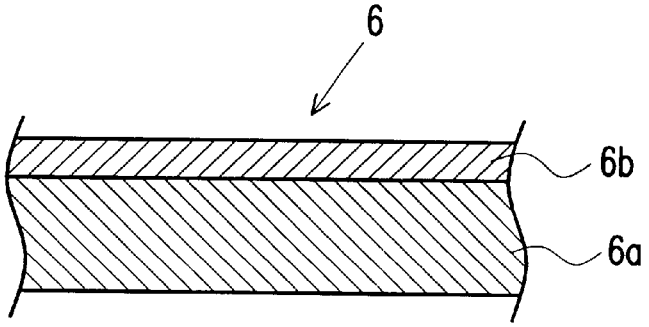
FIG. 5 is shows a portion of a enlarged cross-sectional view of the transfer belt used in the transfer carrying device.

As shown in FIGS. 1 and 2, the roller 5 has a gear 5*b* connected to a driving motor (not shown), so that the roller 5 is rotationally driven by the driving motor. The transfer belt 6 moves in accordance with the roller 5's rotation, and moves in a transporting direction of the transfer paper S (the arrow A's direction in FIG. 3) at a location opposite to the photoreceptor 3. As shown in FIG. 5, the transfer belt 6 is a two-layer structure. In a condition that the electrical resistance is measured according to the JISK6911 standard and a voltage of DV 100 V is applied, the surface layer 6*b*, i.e., the coating layer, is set to have a surface resistance of $1\times10^{9}$ $\Omega\sim1\times10^{12}$ $\Omega$, the surface resistance of the inner layer 6*b* is set to $1\times10^{7}$ $\Omega\sim1\times10^{9}$ $\Omega$, and the volume resistance of the belt 6 is set to $5\times10^{8}$ $\Omega\cdot$cm$\sim5\times10^{10}$ $\Omega\cdot$cm.

In addition, as shown in FIGS. 1 and 3, the rollers 4, 5 is rotatably supported by a supporter 7. The supporter 7 is able to swing in the paper carrying direction as indicated by arrow A by using the roller 5's supporting shaft 5*a* as a fulcrum, wherein the roller 5 is located at a downstream side of the transfer position with respect to the photoreceptor 3. The supporter 7 is operated by a DC solenoid 8 that drives a transfer positioning of the transfer belt 6 based on a signal from a control plate 8A. Namely, a lever is connected to the DC solenoid 8. This lever 9 makes the supporter 7 to move so that the transfer belt 6 is engaged or disengaged with the photoreceptor 3.

As the front end of the transfer paper S, which is aligned with the front-end position of the image formed on the photoreceptor 3 by the resist roller 10 serving as a paper-feeding device, approaches the photoreceptor 3, the control plate 8A generates a driving signal to drive the DC solenoid 8. Therefore, the supporter 7 is approached to the photoreceptor 3 due to the driving of the DC solenoid 8. By the transfer belt 6 being in contact with the photoreceptor 3, a nip portion B, which is capable of making the transfer paper S to be in contact with the photoreceptor 3 and carrying the transfer belt 6, is formed at a position opposite to the photoreceptor 3

Regarding the rollers 4, 5 as described above, the roller 4 located near the photoreceptor 3 forms a driven roller with respect to the roller 5 serving as a driving roller. In addition, as shown in FIG. 2, the surface shape of the roller 4 has tapers 4*a*, 4*b* formed on the two ends on the roller 4, for preventing the transfer belt 6 from leaning to one side. The roller 4 is a conductive roller, such as a metal roller, but only supports the electrical resistant transfer belt 6. The roller 4 might not be directly and electrically connected to other conductive parts. In addition, similar to the contact plate 13 as will be described later, the roller 4 can be feedback to the high voltage power source 12, or grounded.

From the point of view for increasing a gripping force to the transfer belt 6 when being driven by the driving roller 5, the material of the driving roller 5 can be selected from the EPDM rubber, the chloroprene rubber or the silicon rubber, etc. In addition, if the driving roller 5 is not made of rubber, the driving roller 5 can use a conductive roller. A feedback current from the driving roller 5 can be feedback to the high voltage power source 12.

When the rollers 4, 5 are grounded, a transfer control plate 14, which will be described below, is coupled to the rollers 4, 5. If the rollers 4, 5 are grounded at the same time, a feedback current can be also feedback.

The bias roller 11 is disposed at a downstream side of the roller 4 in the transfer belt 6's moving direction so that the bias roller 11 is in contact with the inner side of the transfer belt 6. The bias roller 11 forms a contact electrode for providing charge, having an opposite parity to the toner's electric charge of the photoreceptor 3, to the transfer belt 6, and is connected to the high voltage power source 12.

The contact plate 13 is arranged at on the transfer belt 6's inner surface of the lower side (not the back surface of the transfer surface of the transfer belt 6) near the driven roller 4. As described in following paragraphs, the contact plate 13 suppresses the charge injection towards the transfer paper at the upstream side of the transfer nip portion. The contact plate 13 is used for detecting a current, i.e., a feedback current, that flows on the transfer belt 6. By means of detecting the current, the current supplied from the bias roller 11 can be controlled. Therefore, the transfer control plate 14, for setting the current supplied to the bias roller 11 according to the detected current, is connected to the contact plate 13. The transfer control plate 14 is further coupled to the high voltage power source 12.

Figure 4:
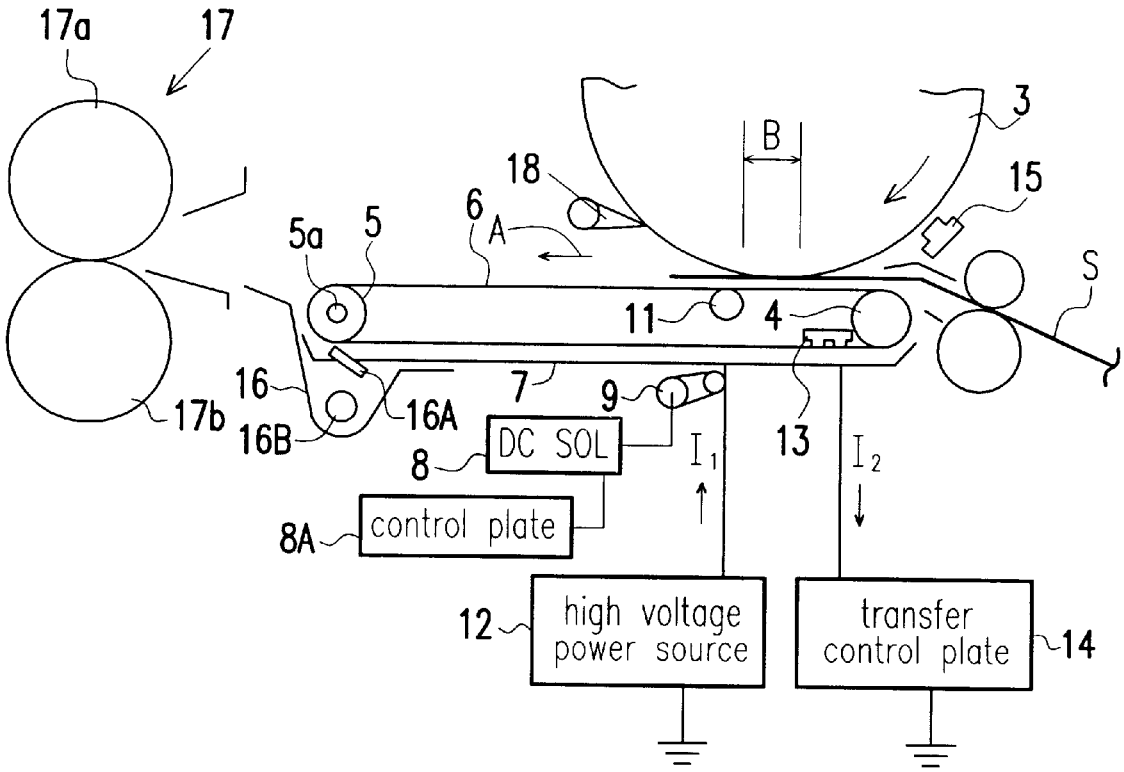
FIG. 4 is conceptual diagram showing a configuration during the transfer operation in the image forming device using the transfer carrying device in FIG. 1.

As shown in FIG. 4, in the aforementioned transfer carrying device 1, in accordance with the transfer paper S being sent out from the resist roller 10, the supporter 7 is set so that the transfer belt 6 is in close contact with the photoreceptor 3. Therefore, a nip portion B with a width of about 4~8 mm, which is equivalent to a length along the transporting direction of the transfer paper S, is formed between the photoreceptor 3 and the transfer belt 6.

Figure 6:
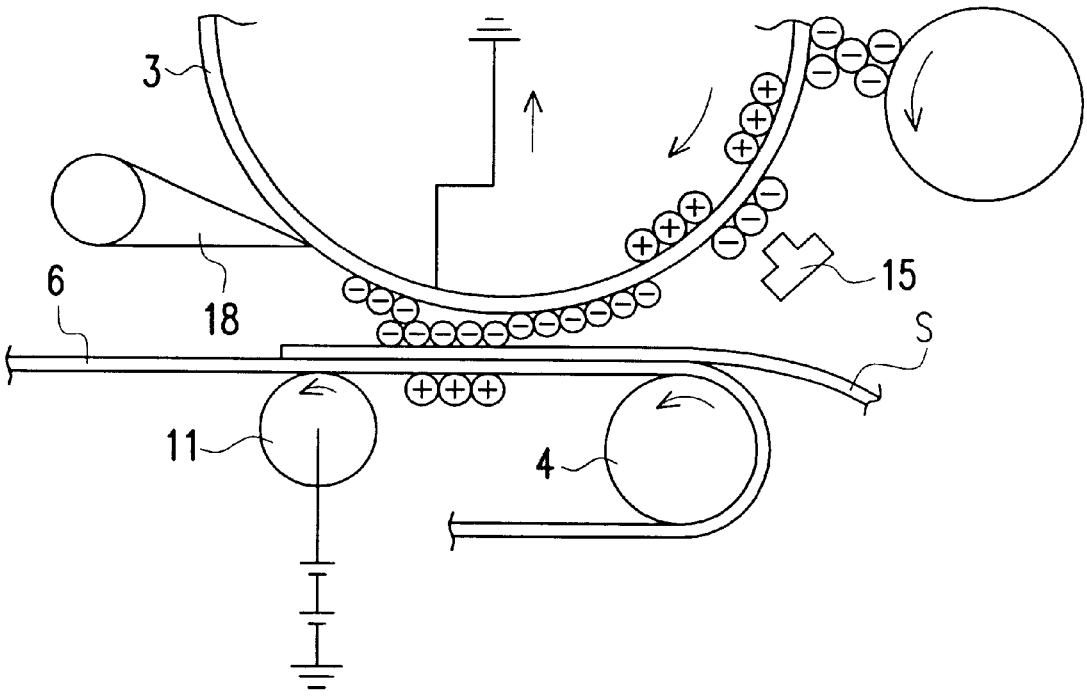
FIG. 6 is an enlarged diagram showing a configuration during the transfer operation in the image forming device using the transfer carrying device.

On the other hand, for an analog machine, the surface of the photoreceptor 3 is charged to have a potential of about −800 V, for example. As shown in FIG. 6, the toner having positive charges on the photoreceptor 3's surface is electrostatically attached to move towards the nip portion B. Then, the surface potential of the photoreceptor 3 is lowered by a pretransfer discharge lamp (PLT) 15 that is disposed in vicinity of the photoreceptor 3 before the nip portion B for reducing the charge amount on the photoreceptor 3's surface. In FIG. 6, the height of the electric charge is represented by a circle's size. The status that the electric charges are reduced by the pretransfer discharge lamp 15 is represented by a circle smaller than the circle before discharge.

At the nip portion B shown in FIG. 4, the toner on the photoreceptor 3 is transferred onto the transfer paper S by the transfer bias from the bias roller 11 located under the transfer belt 6's surface. The transfer bias is applied by the high voltage power source 12 within a range of −1.5 kV~−6.5 kV. However, according to the result of a constant current control set forth below, the transfer bias can be variably set. Namely, as shown in FIGS. 3 and 4, assuming that the current output from the high voltage power source 12 is $I_1$, and the current when detecting the feedback current flowing from the contact plate 13, through the transfer belt 6, to the ground is $I_2$, the value of the current $I_1$ is controlled so that a difference between the two currents $I_1-I_2=I_{out}$ is a constant. This is irrelevant to the environment conditions, such as the temperature or the humidity, or the deviation in manufacturing quality of the transfer belt 6, and is used for eliminating the variation of the transfer efficiency by stabilizing the surface potential Vp on the transfer paper S.

By determining the current $I_{OUT}$ flowing to the photoreceptor 3 through the transfer belt 6 and the transfer paper S, it can avoid the variation, which resulting from that the current flows easily to the transfer belt 6 due to low resistance or high resistance of the surface resistance on the transfer paper S, from influencing on the separation property and the transfer property of the transfer paper S. When the transfer speed is 330 mm/sec and the effective length of the bias roller 11 is 310 mm, the current $I_{OUT}$ is set to 35 $\mu$A±$\mu$5 A to obtain a better transfer.

As the image transfer from the photoreceptor 3 is performed, the transfer paper S is also charged at the same time. Therefore, according to the relationship between the true charge on the transfer belt 6 and the polarization charge occurred on the transfer paper S, the transfer paper S is electrostatically attached onto the transfer belt 6, so that the transfer paper S is separated from the photoreceptor 3. Then, the separation of the transfer paper S is facilitated by a separation operation due to the strength of the transfer paper S itself by using the curvature at a separation position of the photoreceptor 3. However, nevertheless, the transfer paper S, which is electrostatically attached on the photoreceptor 3, can be still separated by a separating claw 18.

On the other hand, the transfer paper S passing through the nip portion B is electrostatically attached to carry in accordance with the moving of the transfer belt 6, and then the transfer paper S is separated at a curvature of a separation position of the driving roller 5. Therefore, the diameter of the driving roller 5 is set equal to or less than 16 mm. Furthermore, when using the driving roller 5, an experimental result shows that a high-quality 45K paper (the rigidity is 21 $cm^3$/100) can be also separated.

In addition, the transfer paper S separated from the transfer belt 6 at the driving roller 5 is guided by a guiding plate (not shown) to carry to between a heating roller 17*a* and a pad roller 17*b* that form a fixing unit 17. At the fixing unit 17, the toner on the transfer paper S is heated to dissolve, and then attached by pressure onto the transfer paper S, so that the toner is fixed on the transfer paper S.

When the transfer belt 6 finishes the image transfer and the separation of the transfer paper S. the lever 9 is released in response to that the magnetization of the DC solenoid 8 is released, and therefore, the supporter 7 is separated from the photoreceptor 3. Then, the surface of the transfer belt 6 is cleaned by a cleaning device 16.

The cleaning device 16 has a cleaning blade 16A. By rubbing the transfer belt 6, the toner or the paper powder of the transfer paper S, which the toner that is not transferred and scattered to the peripheral of the transfer belt 6 or the toner transferred from the photoreceptor 3's surface is adhered, is scratched off.

The transfer belt 6 rubbed by the cleaning blade 16A prevents the increase of the driving force due to the increase of the rubbing resistance or the curl up of the cleaning blade 16A, as a low friction coefficient surface, the surface of the transfer belt 6 is covered by a fuoride resin material, such as the poly vinylidene fluoride, or the tetrafluoride ethylene, etc., is covered on the surface. In addition, the toner or the paper powder on the transfer belt 6's surface can be recycled by a recycle screw (not shown) to a waste toner recycle container.

In the above description and the corresponding drawings, an applying electrode for detecting a surface resistance of the transfer belt 6 is omitted. For example, the applying electrode can be a tube-shaped transfer roller or a belt in contact with the surface of the transfer belt 6. Furthermore, the bias applying device can be a corona charger (CG) or a brush, having an installation position at the upstream or the downstream side of the nip portion B with the photoreceptor 3. The structure of the driving roller and the driven roller etc can have the same structure.

The electrostatic absorption of the transfer paper S might have incomplete separation, in comparison with the aforementioned normal condition for the transfer paper. Therefore, in the present invention, the timing for switching a front end transfer current can be improved to improve the separation property.

Figure 7A:
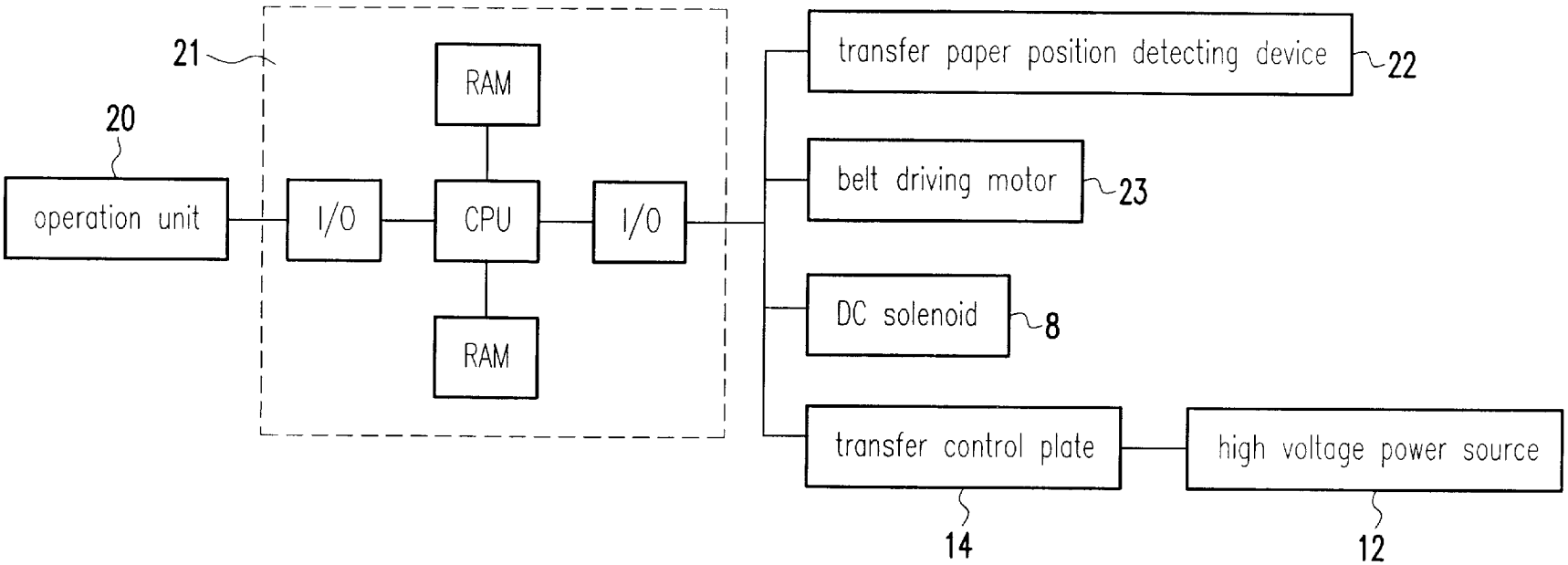
FIGS. 7A and 7B show a controlling block diagram and a applying timing diagram respectively according to the embodiment of the invention.
Figure 7B:
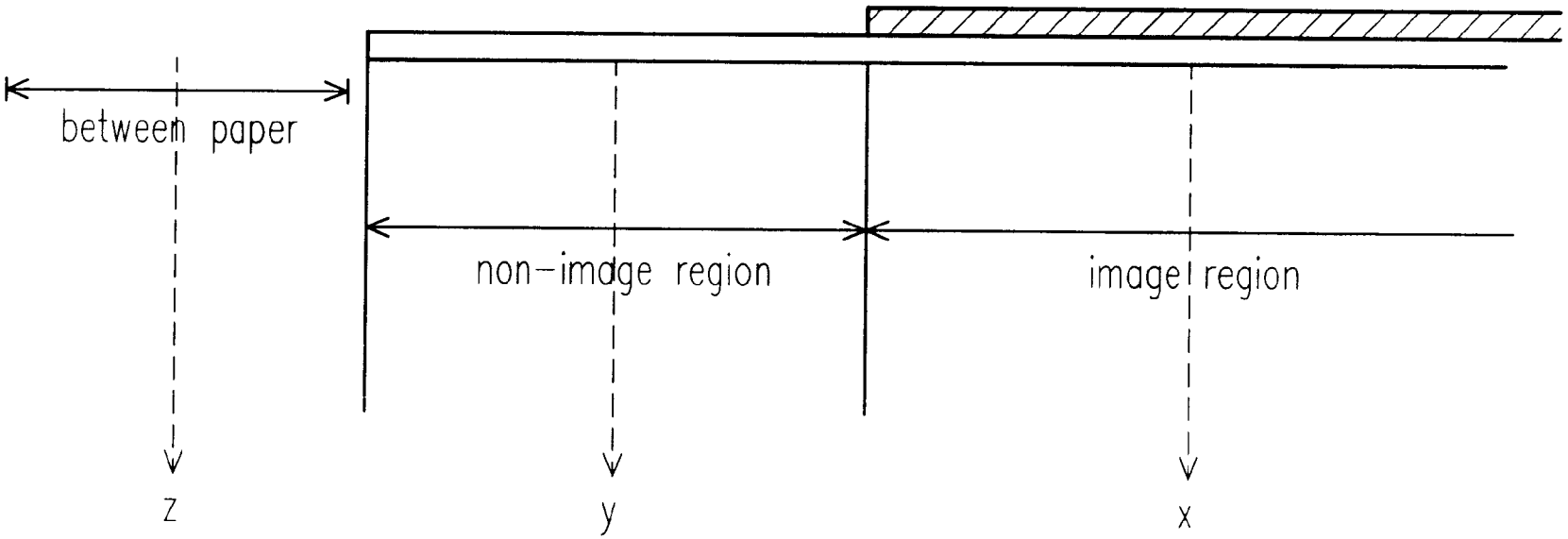

FIGS. 7A and 7B show a controlling block diagram and a applying timing diagram respectively according to the embodiment of the invention. In the following description, La means that a timing of a front end transfer current switching. Namely, assuming La=0 is a base position before the transfer paper S enters the nip portion B, La is a transfer current applying timing measured from the base position. For example, La=20 means that the transfer current applying timing is delayed from the base position by 20 mm.

In FIG. 7A, the controlling block comprises a operation unit 20, a controlling unit 21, a transfer paper position detecting device 22 for detecting a carrying position of the transfer paper S, and a driving motor 23 for driving the transfer belt 6. The transfer paper position detecting device 22 can be replaced by a sensor that is disposed in vicinity of a pretransfer guide.

From FIG. 7B, a comparison of the applying timing between the present invention and the conventional art is described. As shown in FIG. 7B, there are an image region x and a non-image region y on the transfer paper S. In the embodiment, a timing for applying the bias to the non-image region y is used. In contrast, conventionally, the timing for applying the bias is at the between-paper region z. Therefore, according to the embodiment of the present invention, due to the delay of the bias applying timing, the transfer paper S will not be over charged, and the photoreceptor will not be charged in reverse polarity, so that the attachment of the transfer paper S to the photoreceptor can be avoided.

FIGS. 8A~8E show differences of the separation property due to the different belt resistance of the transfer belt S. FIG. 8A shows the belt resistance is very high (extra high), FIG. 8B is high, FIG. 8C is medium, FIG. 8D is low, and FIG. 8E is very low (extra low). The lower the belt resistance is, the worse the separation property gets, so that the reason using the claw 18 to separate the transfer paper S from the photoreceptor can be understood.

Figure 9:
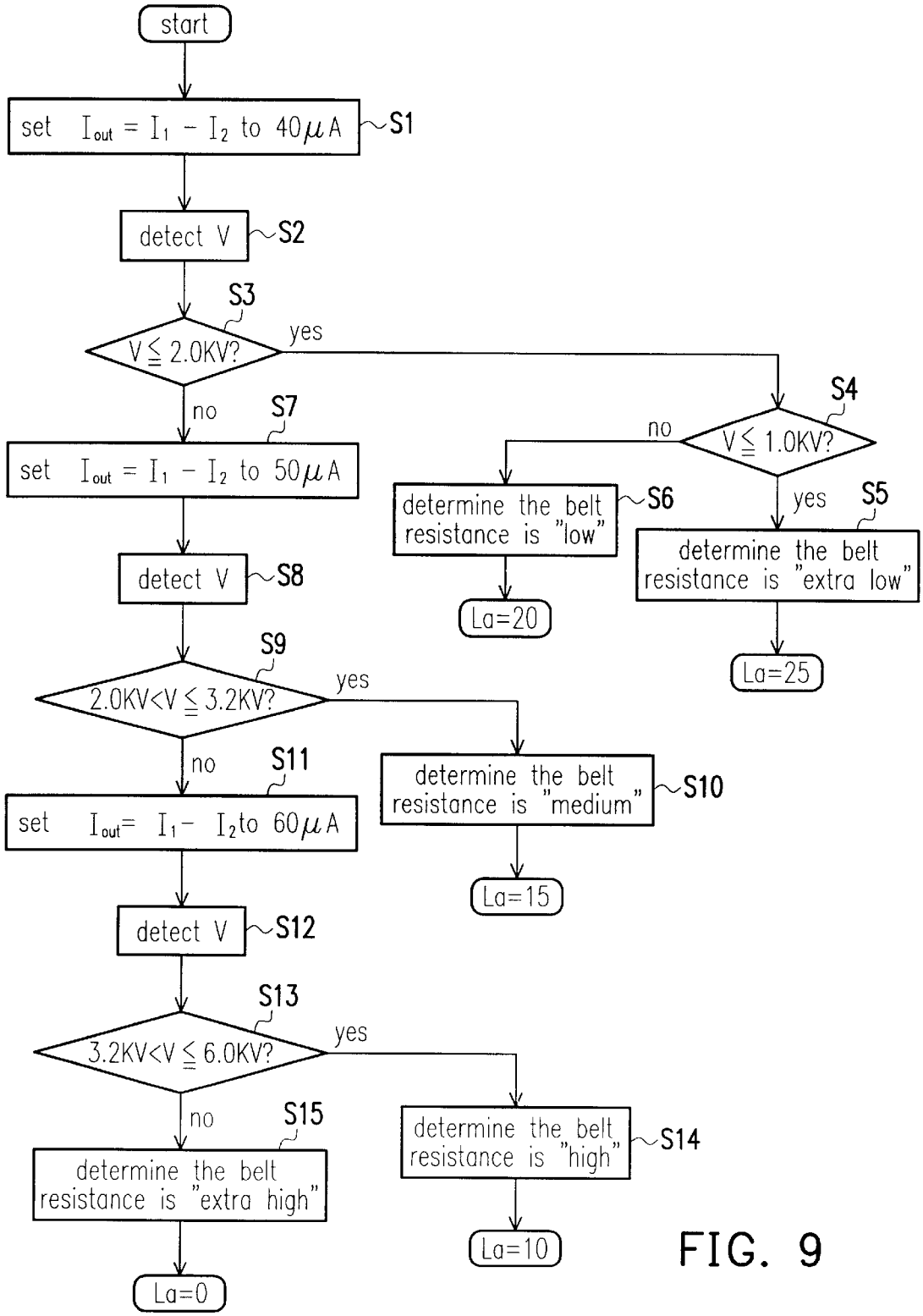
FIG. 9 is a flow chart showing an operation that the transfer belt resistance is detected to change the applying timing La.

FIG. 9 is a flow chart showing an operation that the transfer belt resistance is detected to change the applying timing La. At step S1, the current relationship of $I_1-I_2=I_{OUT}$ is set that $I_{OUT}$ is 40 $\mu$A. At step S2, the applied voltage is detected. If the detected voltage is below 2.0 KV (step S3), whether the detected voltage is below 1.0 KV is further determined (step S4). If yes, the transfer belt resistance is determined as "extra low" (step S5), and the applying timing La is 25. At step S4, if the detected voltage is above 1.0 KV, the transfer belt resistance is determined as "low" (step S6), and the applying timing La is 25. In addition, at step S3, if the detected voltage is above 2.0 KV, the current relationship of $I_1-I_2=I_{OUT}$ is set that $I_{OUT}$ is 50 $\mu$A (step S7). At step S8, the applied voltage is further detected, and then whether the detected voltage is above 2.0 KV but below 3.2 KV is further determined (step S9). If yes, the transfer belt resistance is determined as "medium" (step S10), and the applying timing La is 15. If the result at step S9 is no, the current relationship of $I_1-I_2=I_{OUT}$ is set that $I_{OUT}$ is 60 $\mu$A (step S11). At step S12, the applied voltage is further detected, and then whether the detected voltage is above 3.2 KV but below 6.0 KV is further determined (step S13). If yes, the transfer belt resistance is determined as "high" (step S14), and the applying timing La is 10. If the result at step S13 is no, the transfer belt resistance is determined as "extra high" (step S15), and the applying timing La is 0.

FIG. 8 shows some extents of the separation property due to the difference of bias between papers. In this case, the resistance detecting operation is the same as that is FIG. 9. In addition, FIG. 10 shows bias values between papers when both the front end current switching and the current switching between papers are performed.

According to the image forming device mentioned above, even though the transfer paper has an ill separation property, the separation property of the image carrier can be still improved.

Furthermore, even though the separation characteristic of the image carrier is different due to the different resistance of the transfer carrying device, the applying timing is changeable according to the resistance, so that an optimum separation property can be maintained.

In addition to the above effects, the transfer current between papers can be changed due to the transfer belt's resistance, so that the separation property can be further improved.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. An image forming device, comprising:

an image supporter, for supporting a toner image;

a transfer carrying unit, for supporting a sheet-shaped transfer paper, and for transferring the toner image on the image supporter to the supported transfer paper;

a cleaning unit, for cleaning the transfer carrying unit;

a unit, for stretching and laying the transfer carrying unit; and a transfer bias supplying unit, for supplying a transfer bias to the transfer carrying unit;

wherein an applying timing for applying the transfer bias to the transfer carrying unit is at least after the transfer paper enters a nip portion between the image supporter and the transfer carrying unit, and an applying position for applying the transfer bias is within a non-image region of the transfer paper.

2. The device of claim 1, further comprising a resistance detecting unit, for detecting a resistance of the transfer carrying unit, and wherein the applying timing for applying the transfer bias to the transfer carrying unit is changeable according to the resistance detected by the resistance detecting unit.

3. The device of claim 2, wherein a transfer bias, which is applied between the transfer papers, of the transfer carrying unit is changeable according to the resistance detected by the resistance detecting unit.

4. The device of claim 1, wherein a volume resistance of the transfer carrying unit is $5\times10^8$~$5\times10^{10}$.

5. The device of claim 1, wherein the image supporter is an photoreceptor, a stained amount on the photoreceptor that is indicated by a printac ID is below a certain critical level.

6. The device of claim 1, wherein the applying timing for applying the transfer bias is determined under following steps:

setting a bias current to a first current value, wherein the bias current is applied to the transfer carrying unit;

detecting the transfer bias;

determining whether the detected transfer bias is smaller than a second transfer bias;

setting the applying timing to a first delay position, if the detected transfer bias is smaller than the second transfer bias;

setting the applying timing to a second delay position, if the detected transfer bias is larger than the second transfer bias;

setting the bias current to a second current value and then detecting the transfer bias again, if the detected transfer bias is larger than the first transfer bias;

setting the applying timing to a third delay position, if the detected transfer bias is larger than the first transfer bias and smaller than a third transfer bias;

setting the bias current to a third current value and then detecting the transfer bias again, if the detected transfer bias is not within a range between first transfer bias and the third transfer bias;

setting the applying timing to a fourth delay position, if the detected transfer bias is larger than the third transfer bias and smaller than a fourth transfer bias; and setting the applying timing to a base position, if the detected transfer bias is not within a range between the third transfer bias and the fourth transfer bias;

wherein the base delay position, the fourth, the third, the second and the first delay positions are arranged in sequence, and measured in distance, and wherein the base delay position is set to 0.

7. A method for forming an image, for an image forming device, wherein the device comprises at least an image supporter, for supporting a toner image; a transfer carrying unit, for supporting a sheet-shaped transfer paper, and for transferring the toner image on the image supporter to the supported transfer paper; a cleaning unit, for cleaning the transfer carrying unit; a unit, for stretching and laying the transfer carrying unit; and a transfer bias supplying unit, for supplying a transfer bias to the transfer carrying unit; the method comprising steps of setting a bias current to a first current value, wherein the bias current is applied to the transfer carrying unit;

detecting the transfer bias;

determining whether the detected transfer bias is smaller than a second transfer bias;

setting the applying timing to a first delay position, if the detected transfer bias is smaller than the second transfer bias;

setting the applying timing to a second delay position, if the detected transfer bias is larger than the second transfer bias;

setting the bias current to a second current value and then detecting the transfer bias again, if the detected transfer bias is larger than the first transfer bias;

setting the applying timing to a third delay position, if the detected transfer bias is larger than the first transfer bias and smaller than a third transfer bias;

setting the bias current to a third current value and then detecting the transfer bias again, if the detected transfer bias is not within a range between the first transfer bias and the third transfer bias;

setting the applying timing to a fourth delay position, if the detected transfer bias is larger than the third transfer bias and smaller than a fourth transfer bias; and setting the applying timing to a base position, if the detected transfer bias is not within a range between the third transfer bias and the fourth transfer bias;

wherein the base delay position, the fourth, the third, the second and the first delay positions are arranged in sequence, and measured in distance, and wherein the base delay position is set to 0; and wherein the applying timing for applying the transfer bias to the transfer carrying unit is at least after the transfer paper enters a nip portion between the image supporter and the transfer carrying unit, and an applying position for applying the transfer bias is within a non-image region of the transfer paper.

8. The method of claim 7, wherein the applying timing for applying the transfer bias to the transfer carrying unit is changeable according to a resistance for detecting a resistance of the transfer carrying unit.

9. The method of claim 8, wherein a transfer bias, which is applied between the transfer papers, of the transfer carrying unit is changeable according to the resistance detected by the resistance detecting unit.

10. The method of claim 7, further comprising setting a volume resistance of the transfer carrying unit to $5\times10^{8}$~$5\times10^{10}$.

11. The method of claim 7, further comprising setting a stained amount on the image supporter that is indicated by a printac ID below a certain critical level.

* * * * *